US009149699B2

(12) United States Patent
Tai

(10) Patent No.: US 9,149,699 B2
(45) Date of Patent: Oct. 6, 2015

(54) BASEBALL PITCHING TRAINING DEVICE

(71) Applicant: Chih-Cheng Tai, Santa Clara, CA (US)

(72) Inventor: Chih-Cheng Tai, Santa Clara, CA (US)

( * ) Notice: Subject to any disclaimer, the term of this patent is extended or adjusted under 35 U.S.C. 154(b) by 0 days.

(21) Appl. No.: 13/712,377

(22) Filed: Dec. 12, 2012

(65) Prior Publication Data

US 2013/0150189 A1 Jun. 13, 2013

Related U.S. Application Data

(60) Provisional application No. 61/569,912, filed on Dec. 13, 2011.

(51) Int. Cl.

| | |
|---|---|
| ***A63B 69/00*** | (2006.01) |
| ***A63B 37/14*** | (2006.01) |
| ***D05B 15/00*** | (2006.01) |
| *A63B 71/06* | (2006.01) |

(52) U.S. Cl.

CPC ..... *A63B 69/0002* (2013.01); *A63B 37/14* (2013.01); *D05B 15/00* (2013.01); *A63B 2069/0006* (2013.01); *A63B 2071/0655* (2013.01); *A63B 2071/0694* (2013.01)

(58) Field of Classification Search

CPC ..... A63B 69/00; A63B 69/0002; A63B 2069/0006; A63B 41/08; A63B 45/00; A63B 2243/0004; A63B 2243/0008; A63B 2037/125

USPC ..... 473/422, 451, 458, 597–600; D21/713

See application file for complete search history.

(56) References Cited

U.S. PATENT DOCUMENTS

| | | | | | |
|---|---|---|---|---|---|
| 1,861,157 | A | * | 5/1932 | Grady | 473/598 |
| 1,980,472 | A | * | 11/1934 | Clarke | 473/598 |
| 2,815,211 | A | * | 12/1957 | Grandinette | 473/598 |
| 2,925,273 | A | * | 2/1960 | Pratt | 473/451 |
| 3,110,494 | A | * | 11/1963 | Morgan | 473/458 |
| 4,822,041 | A | * | 4/1989 | Molitor | 473/597 |
| 4,840,378 | A | * | 6/1989 | Molitor | 473/600 |
| 5,253,865 | A | * | 10/1993 | Kinnee | 473/598 |
| 5,407,193 | A | * | 4/1995 | McGinley | 473/451 |
| 5,664,774 | A | * | 9/1997 | Walker et al. | 473/600 |
| 5,772,544 | A | * | 6/1998 | Yang | 473/598 |
| 5,893,808 | A | * | 4/1999 | Bennett | 473/451 |
| 6,190,273 | B1 | * | 2/2001 | Maxey et al. | 473/598 |
| 6,500,081 | B1 | * | 12/2002 | Chen | 473/598 |
| 6,663,519 | B2 | * | 12/2003 | Kuhn et al. | 473/458 |
| D630,689 | S | * | 1/2011 | Tsutsui | D21/713 |

* cited by examiner

*Primary Examiner* — Mitra Aryanpour

(74) *Attorney, Agent, or Firm* — Haverstock & Owens LLP

(57) ABSTRACT

A pitching training device comprises a typical baseball with raised pitching training structure on top of the stitches on the seam. The pitching training structure is able to be an additional layer of stitches on top of the typical stitches of a baseball. The pitching training structure provides a finger rest area allowing a user to spin the baseball more easily at a breaking ball pitching release.

12 Claims, 4 Drawing Sheets

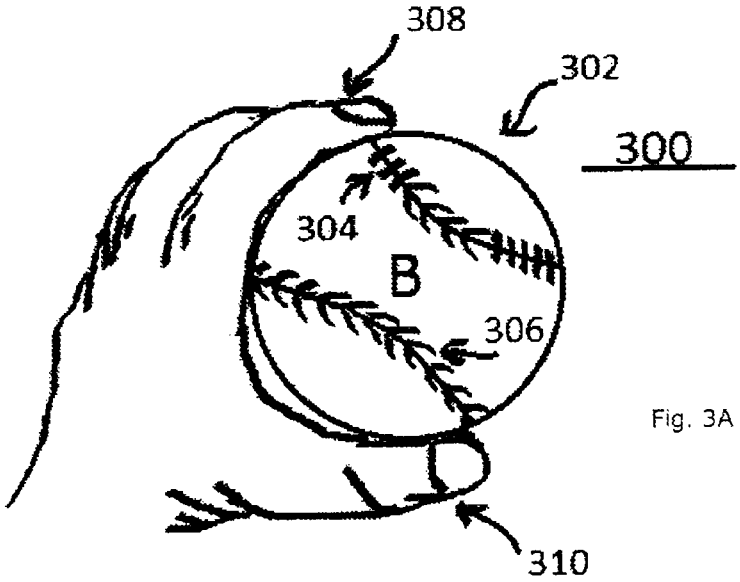
Fig. 3A
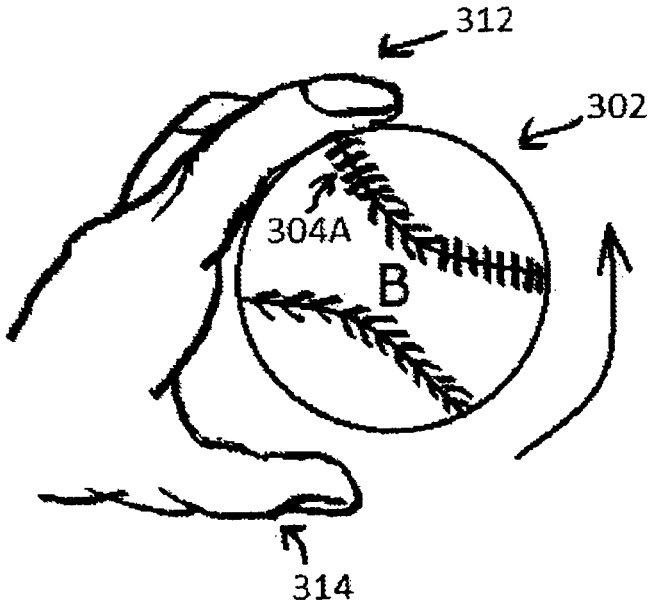
Fig. 3B
Fig. 3

BASEBALL PITCHING TRAINING DEVICE

CROSS-REFERENCE TO RELATED APPLICATION(S)

The present invention claims priority to the U.S. provisional patent application Ser. No. 61/569,912, titled "Baseball Pitching Training Device," filed on Dec. 13, 2011, which is incorporated by reference in its entirety for all purposes.

FIELD OF THE INVENTION

The present invention relates to sports training device. Specifically, the present invention relates to a ball pitching training device for enhancing pitching skills.

BACKGROUND OF THE INVENTION

Various baseball pitches are able to be performed by varying the grip and the throwing motion of the ball, which results in different ball trajectories, speeds, and movements. Common pitches include a two-seam fastball, a four-seam fastball, a slider, a fork ball (split finger), a sinker, a cutter, a curveball, a screwball, a changeup, and a knuckle ball, among others. Learning how to master various pitches is the goal of many aspiring athletes, but the task can be difficult because there are many details to learn and practice, including pitch-specific grips and pitch-specific throwing dynamics.

SUMMARY OF THE INVENTION

In an aspect, a pitching training device comprises a baseball comprising a skin portion and a seam portion, wherein the seam portion is substantially on a same surface with the skin portion and a raised stitch covering at least a portion of the seam portion. In some embodiments, the raised stitch provides a raised structure allowing a user's finger to spin the baseball more easily. In other embodiments, the seam portion comprises a thread stitch. In some other embodiments, the raised stitch covers at least a portion of the thread stitch. In some embodiments, the raised stitch covers less than entire the seam portion. In other embodiments, the raised stitch covers a half of the seam portion. In some other embodiments, the raised stitch comprises a first raise stitch portion and a second raise stitch portion having a gap between the first stitch portion and the second stitch portion. In some embodiments, the raised stitch has a height less than 0.5 cm (0.19685 inch). In other embodiments, the raised stitch has a width less than 1.3 cm (0.511811 inch). In some embodiments, the raised stitch has a higher threading density than a threading density of a thread of the seam portion.

In a second aspect, a pitching training device comprises a first dumbbell shape skin coupled with a second dumbbell shape skin forming an outer skin of a ball and an embossed finger placement on top of a joining place of the first dumbbell shape skin and the second dumbbell shape skin. In some embodiments, the first dumbbell shape skin is made of leather, PVC (polyvinylchloride), PU (polyurethane), or a combination thereof. In other embodiments, the embossed finger placement comprises a stitch. In some other embodiments, the embossed finger placement comprises a polymeric material.

In a third aspect, a method of making a pitching training device comprises joining a first skin portion and a second skin portion by a first thread to form a surface of a ball and forming a raised structure on the surface. In some embodiments, the method further comprises sewing a second thread to form a raised seam on the surface. In other embodiments, the second thread has a higher density than the first thread. In some other embodiments, the raised structure provides a stronger first finger grip structure than a second finger grip structure of the first thread. In some embodiments, the method further comprises stitching the raised structure over the first thread. In some embodiments, the raised structure has a height less than 0.8 cm (0.314961 inch).

BRIEF DESCRIPTION OF THE DRAWINGS

FIGS. 1A-1F illustrate a pitching training device in accordance with some embodiments of the present invention.

FIG. 3 which include FIGS. 3A-3B illustrate a method of using the pitching training device in accordance with some embodiments of the present invention.

DETAILED DESCRIPTION OF THE PREFERRED EMBODIMENTS

A pitching training device comprises a ball having a skin portion, first stitches, and second stitches. In some embodiments, the skin portion comprise a first dumbbell shape portion and a second dumbbell shape portion. The first stitches are able to join the first dumbbell shape portion and a second dumbbell shape portion forming an outer surface of the ball. In some other embodiments, the first and the second stitches together join the first dumbbell shape portion and a second dumbbell shape portion forming an outer surface of the ball. The first stitches are able to form a seam of the ball. In some embodiments, the second stitches cover at least a portion of the first stitches forming an embossed structure. In some embodiments, the embossed structure provides more fiction, holding surface, rotating leverage, or a combination thereof to a user's fingers comparing to a typical baseball. The embossed structure formed by the second stitches allows a user to spin the ball easier than the stitches on a typical baseball.

In some embodiments, the second stitches is overlapping the first stitches, thereby there are two layers of stitches on the seam of a baseball. In some embodiments, the second stitches on a typical baseball forms the pitching training structure. In some other embodiments, the second stitches formed as an embossed structure join at least a portion of or entire the first dumbbell shape portion and a second dumbbell shape portion without having the first stitches underneath the second stitches.

The embossed structure is able to provide a grip assistant to a user such that the user is able to spin the ball at the time of releasing a breaking ball pitch.

Figure 1:
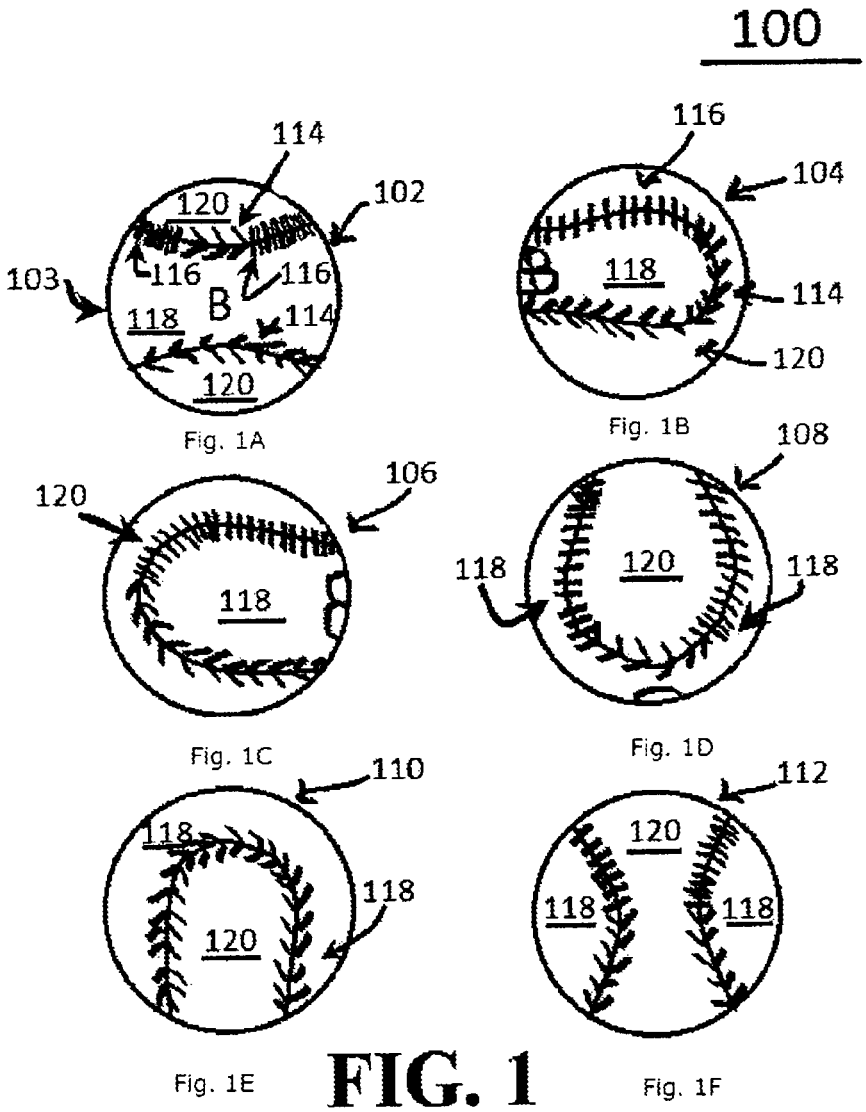
FIG. 1 which include

FIG. 1 illustrates a pitching training device 100 in accordance with some embodiments of the present invention. The front view 102 of the pitching training device 100 comprises a first dumbbell shape portion 118 and a second dumbbell shape portion 120 of a skin 103. First stitches 114 are able to join the first dumbbell shape portion 118 and the second dumbbell shape portion 120 of a skin 103. The pitching training device 100 is able to comprise second stitches 116 forming an embossed structure extending upward beyond the surface of the skin 103. In some embodiments, the second stitches 116 overlap/on top of a portion of the first stitches 114. In some other embodiments, the second stitches 116 join the first dumbbell shape portion 118 and a second dumbbell shape portion 120 of a skin 103 without having the first stitches 114 underneath of the second stitches 116.

Views 104 and 106 of the pitching training device 100 illustrate the right and left side views (90 degree turn) respectively of the pitching training device 100. View 108 illustrates the top view of the pitching training device 100. View 110 illustrates the bottom view of the pitching training device 100. View 112 illustrates the back side view of the pitching training device 100. A person or ordinary skill in the art appreciates that the second stitches are able to be placed in any pre-selected location on the skin 103 or on top of any selected portions of 20 the first stitches 114. In some embodiments, the second stitches 116 go around/surround the entire joining seam between the first dumbbell shape portion 118 and the second dumbbell shape portion 120, thereby the second stitches 116 join the first dumbbell shape portion 118 and the second dumbbell shape portion 120 without the first stitches 114.

Figures 2, 2A, 2B, 2C, 2D, 2E:
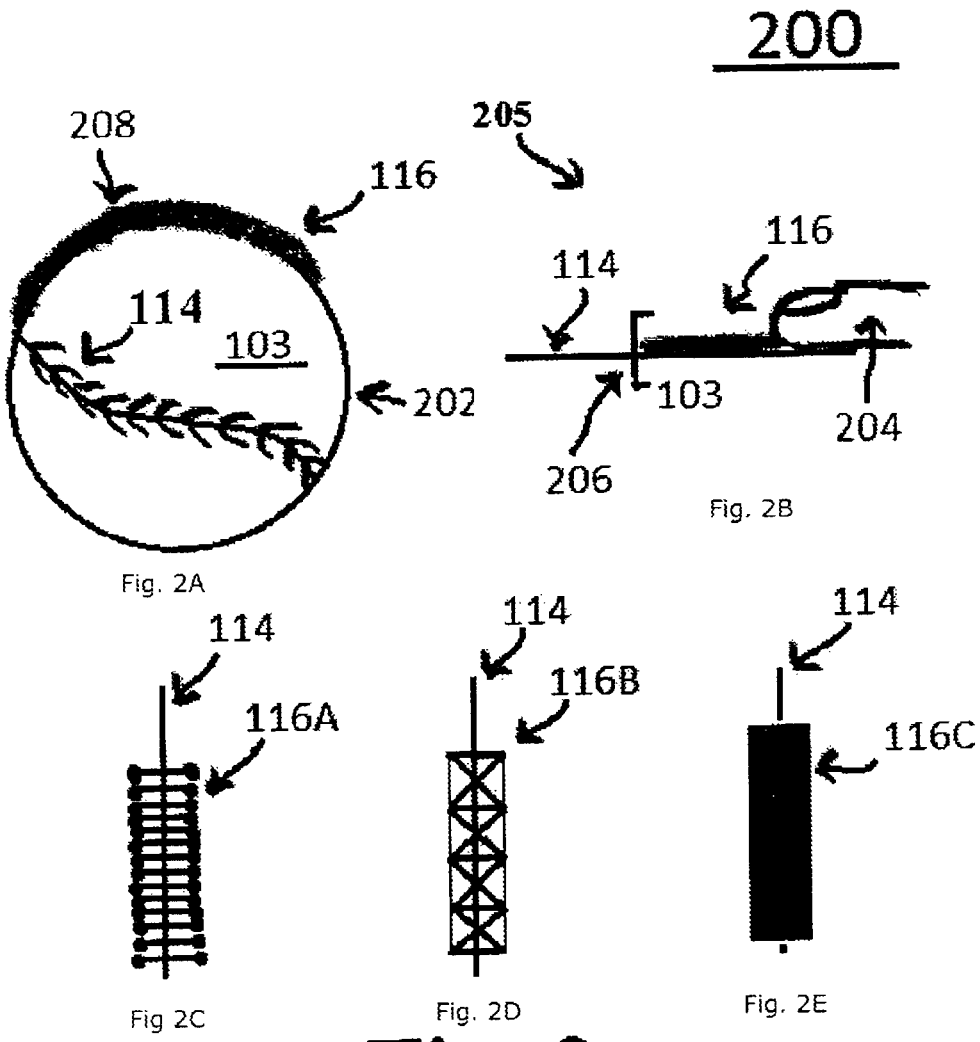
FIG. 2 which include
FIGS. 2A-2E illustrate a pitching training structure of the pitching training device in accordance with some embodiments of the present invention.

FIG. 2 illustrates a pitching training structure 200 of the pitching training device in accordance with some embodiments of the present invention. The pitching training device 200 is able to be the same as the pitching training device 100 of FIG. 1. The numbering system used in FIG. 1 is also applicable to FIG. 2. The pitching training device 200 is able to comprise a surface comprising the skin 103 and the first stitches 5 114. The second stitches 116 are protruding/extending beyond the surface 202. The second stitches 116 (the pitching training structure of the pitching training device) is able to be made by thread, cotton yarn, and/or wool yarn. As shown in the drawing 205, the second stitches forms an embossed structure 206 allowing a finger 204 of a user to rest on, such 10 that a finger 204 is able to spin the pitching training device 200 at a ball releasing motion. The second stitches are able to be made into various patterns such as the straight crossing lines 116A, the double crossing lines 116B, or a solid block 116C. A person of ordinary skill in the art appreciates that the second stitches are able to be in any pattern.

In some embodiments, the second stitches are able to contain a finger placing concave structure complimentary to the convex structure of a user's finger, such as index or middle finger. In some embodiments, the second stitches are able to be shaped for better finger placement, shaped ergonomically, or shaped for generating highest spinning speed or spinning momentum. A person of ordinary skill in the art appreciates that the second stitches are able to be shaped for any predetermined purposes.

In some embodiments, the pitching training device 200 comprises a pitching training element 208 that is able to provide the same function as described above but is made by a different material for the second stitches 116. The pitching training element 208 is able to be made by polymers, such as polyethylene (PE), polypropylene (PP), rubber, and any other polymeric materials. A person of ordinary skill the in the art appreciates that the pitching training element 208 is able to be in any shape or by any material so long as the pitching training element 208 is able to provide a physical holding structure allowing a user/pitcher to rest his forger and spin the ball at a ball releasing motion.

FIG. 3 illustrates a method 300 of using the pitching training device 300 in accordance with some embodiments of the present invention. At a gripping position, both a finger 308 and the thumb 310 are gripping on the ball 302. The finger 308 frictionally engages and rests on the stitches 304 that are protruding out of the surface of the ball 302. At a pitching release, the thumb 314 leaves the surface of the ball 302 and a finger 312 is able to spin the ball by applying force on the embossed stitches/structure 304A. In some embodiments, the embossed stitches 304A have a width about 10 mm (0.393 inch) and a thickness about 2 mm (0.0787402 inch). In other embodiments, the stitches 304A are no thicker than 5 mm (0.19685 inch). In some other embodiments, the stitches 304A have a thickness do not affect the flying trajectory of the baseball or the feeling of a user to use it like a regular baseball.

Figure 4:
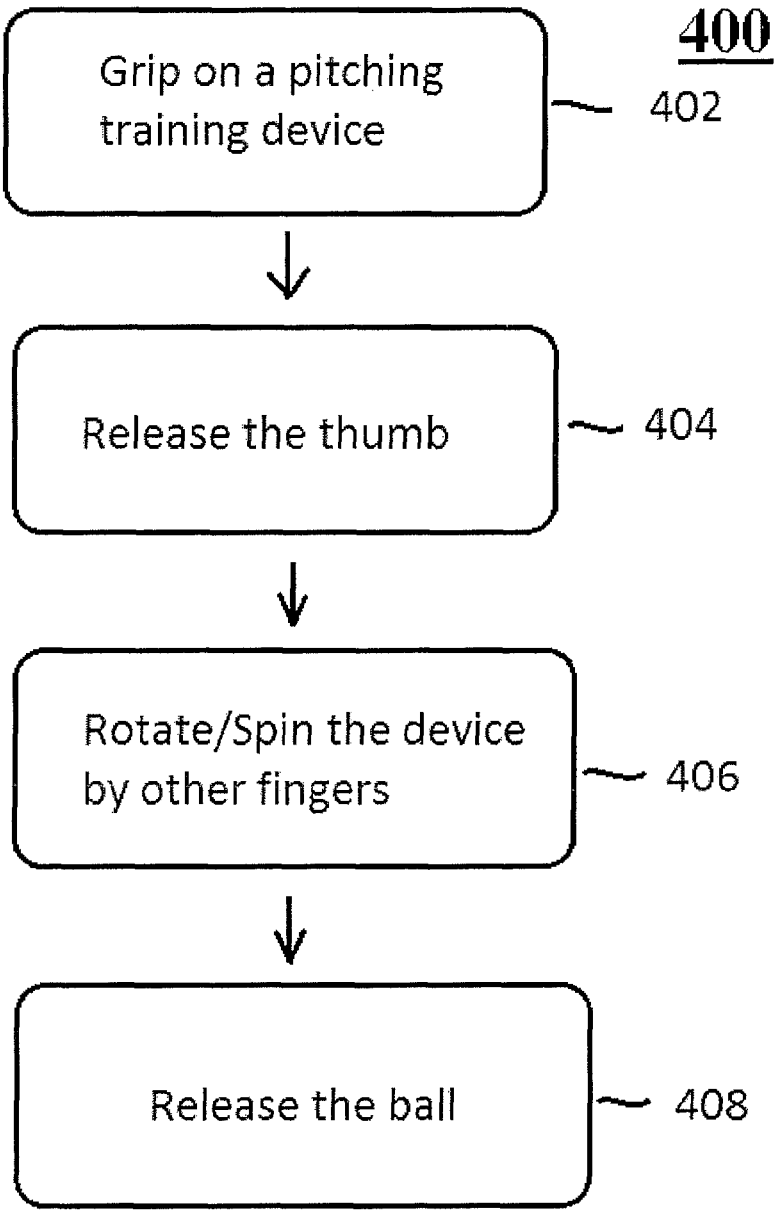
FIG. 4 is a flow chart illustrating a method of using the pitching training device in accordance with some embodiments of the present invention.

FIG. 4 is a flow chart illustrating a method of using the pitching training device in accordance with some embodiments of the present invention. At Step 402, a pitching training device is gripped. At Step 404, the thumb that is gripped on the training device is released. At Step 406, using other fingers rotate/spin the device. At Step 408, the ball (device) is released, such that a breaking ball is pitched through a ball rotational motion.

The pitching training device is able to be utilized in training a baseball pitching motion. The pitching training device is advantageous in many aspects. For example, a user is able to enhance/gain muscle memory by practicing throwing breaking balls with the training device. After switching back to a typical baseball, the muscle memory acquired through using the pitching training device allows the users brain to memorize how to pitch a breaking ball more easily. In operation, the training device is able to be more easily gripped and extending the finger retention time on the device because of the embossed stitches/protrusions providing an extra spin leverage arm.

A person of ordinary skill the art appreciates that the pitching training device is able to be made as close to typical baseball but with the enhanced gripping (stitches) mechanisms/structures. Any patterns with embossed structure or dipped structure on the ball are within the scope of the present invention. The pitching training device is able to be patterned for use by a left-handed pitcher, right-handed pitcher, or both. For example, the stitches are able to be shaped with a holding structure allowing a left-handed pitcher to spin more easily.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A pitching training device comprising:

a) a baseball comprising a skin portion and a seam portion, said seam portion having first and second portions;

b) a first set of raised stitches in a shape of a solid block covering at least the first portion of the seam portion; and c) a second set of stitches covering the second portion of the seam portion.

2. The device of claim 1, wherein the first set of raised stitches provide a raised structure, allowing a user's finger to spin the baseball more easily.

3. The device of claim 1, wherein the seam portion comprises a thread stitch.

4. The device of claim 1, wherein the first set of raised stitches cover less than the entire seam portion.

5. The device of claim 1, wherein the first set of raised stitches cover a half of the seam portion.

6. The device of claim 1, wherein the first set of raised stitches comprise a first raised stitch portion and a second raised stitch portion having a gap between the first raised stitch portion and the second raised stitch portion.

7. The device of claim 1, wherein the first set of raised stitches have a height less than 0.5 cm.

8. The device of claim 1, wherein the first set of raised stitches have a width less than 1.3 cm.

9. The device of claim 1, wherein the first set of raised stitches have a higher thread density than a thread density of the second set of stitches.

10. A pitching training device comprising:

a) a first dumbbell shape skin coupled to a second dumbbell shape skin to form an outer skin of a baseball, said first and second shape skins forming a seam when coupled together, said seam having first and second seam portions;

b) a first set of embossed stitches in a shape of a raised, solid block for placement on at least the first portion of the seam portion; and c) a second set of stitches covering the second portion of the seam portion.

11. The device of claim 10, wherein the first dumbbell shape skin and the second dumbbell shape skin are each formed of a material consisting of: leather, polyvinyl chloride, polyurethane, and a combination thereof.

12. The device of claim 10, wherein the first set of embossed stitches comprises a polymeric material.

* * * * *